US010751563B2

(12) United States Patent
Anderson

(10) Patent No.: US 10,751,563 B2
(45) Date of Patent: Aug. 25, 2020

(54) RECUMBENT EXERCISE BICYCLE ATTACHMENT (REBA)

(71) Applicant: Terence Anderson, Grand Junction, CO (US)

(72) Inventor: Terence Lee Anderson, Grand Junction, CO (US)

( * ) Notice: Subject to any disclaimer, the term of this patent is extended or adjusted under 35 U.S.C. 154(b) by 172 days.

(21) Appl. No.: 15/947,797

(22) Filed: Apr. 7, 2018

(65) Prior Publication Data

US 2019/0308064 A1 Oct. 10, 2019

(51) Int. Cl.
*A63B 22/06* (2006.01)
*A63B 21/22* (2006.01)

(52) U.S. Cl.
CPC ..... *A63B 22/0605* (2013.01); *A63B 21/225* (2013.01); *A63B 2022/0652* (2013.01); *A63B 2225/093* (2013.01)

(58) Field of Classification Search
CPC ..... A63B 22/0605; A63B 2022/0652; A63B 23/0476; A63B 69/16; A63B 2069/164–166
See application file for complete search history.

(56) References Cited

U.S. PATENT DOCUMENTS 4,140,312 A * 2/1979 Buchmann ..... A63B 22/0007 482/62
4,762,317 A * 8/1988 Camfield ..... A63B 22/0076 482/62
4,824,132 A * 4/1989 Moore ..... A61G 5/023 280/250.1
5,580,337 A * 12/1996 Habing ..... A63B 22/0046 482/142
5,904,638 A * 5/1999 Habing ..... A63B 22/0605 482/57
5,961,423 A * 10/1999 Sellers ..... A63B 22/001 482/52
6,607,470 B2 * 8/2003 Catanescu ..... A63B 22/0694 482/57
9,039,581 B2 * 5/2015 Chia ..... A63B 22/06 482/133
2009/0088300 A1 * 4/2009 Catanescu ..... A61H 1/0214 482/51
2013/0260965 A1 * 10/2013 Chia ..... A63B 22/06 482/57
2016/0082311 A1 * 3/2016 Massaro ..... A63B 22/0005 482/63

* cited by examiner

*Primary Examiner* — Michael McCullough

(57) ABSTRACT

The Recumbent Exercise Bicycle Attachment (REBA) connects to an upright flywheel type exercise bicycle which utilizes one knob friction brake control. The functionality of the existing upright bicycle is maintained by using the REBA's modified interchangeable controls. The pedals that turn the flywheel and the resistance control of the bicycle are accessed from the REBA by utilizing the seat and rear control which are a part of the REBA. The REBA allows the user to ride either in the upright cycling position or the recumbent cycling position on one machine.

1 Claim, 10 Drawing Sheets

RECUMBENT EXERCISE BICYCLE ATTACHMENT (REBA)

BACKGROUND OF THE INVENTION

The REBA unites two types of existing exercise bicycle technology, devices pedaled in the upright cycling position, and devices pedaled in the recumbent position. The pedals that turn the flywheel, and resistance control of the upright cycling device are accessed from the REBA. The benefits of both positions are numerous and vary significantly for each position. The REBA allows its user to obtain the benefits of either position from one machine.

BRIEF SUMMARY OF THE INVENTION

The exercise bicycle is widely used to enhance personal fitness, and as a means to assist in the rehabilitation from many types of injury. The REBA converts a flywheel type exercise bicycle utilizing one knob friction brake control, into dual-purpose work stations, suitable for individuals, health clubs and physical therapy. The REBA provides for separate, interchangeable knob controls which allow for precise, consistent and accessible adjustment of flywheel resistance from either riding position. The recumbent seat adjusts to the leg length of the user, has seat to pedal geometry consistent with recumbent bicycles, and does not impede adjustment to the seat and handle bars of the existing exercise bicycle. The REBA creates one new machine, providing users the varied seating position necessary to obtain real physiological diversification in their cycling workouts, whether for fitness or rehabilitation. The REBA accommodates some disabled users to an extent not currently available in many existing exercise bicycles. Users unable to mount or ride an upright exercise bicycle can sit and ride comfortably on a simple solid device. The REBA requires no power source and is free of electronics of any kind.

DETAILED DESCRIPTION OF THE INVENTION

DETAILED DESCRIPTION

Figure 1:
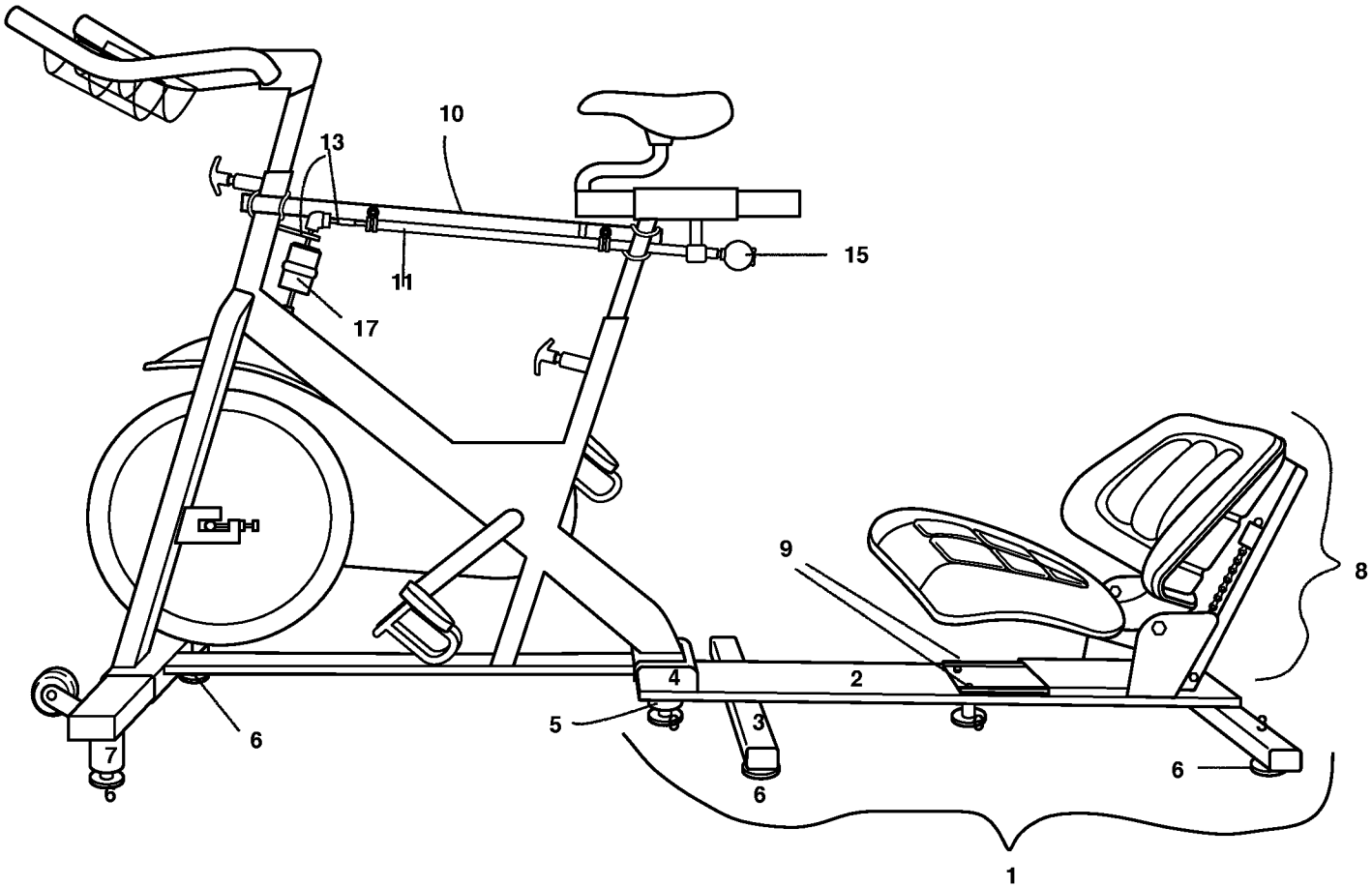
FIG. 1. Side view of Recumbent Exercise Bicycle Attachment (REBA) connected to existing exercise bicycle FIG. 2. Rear view of REBA connected to existing exercise bicycle FIG. 3. Side view of REBA platform including attachment to existing exercise bicycle FIG. 4. Side view of REBA seat bolted to platform FIG. 5. Rear view of REBA seat bolted to platform FIG. 6. Detailed view of REBA platform connecting to existing bicycle FIG. 7. Detailed view of REBA riser under exercise bicycle front cross support FIG. 8. Detailed side view of REBA rear control assembly FIG. 9. Detailed top view of REBA rear control assembly FIG. 10. Exploded view of REBA rear and front control assemblies FIG. 11. Detailed side view of REBA New Control Knob FIG. 12. Detailed side view of REBA New Flywheel Brake Control Rod
Figure 2:
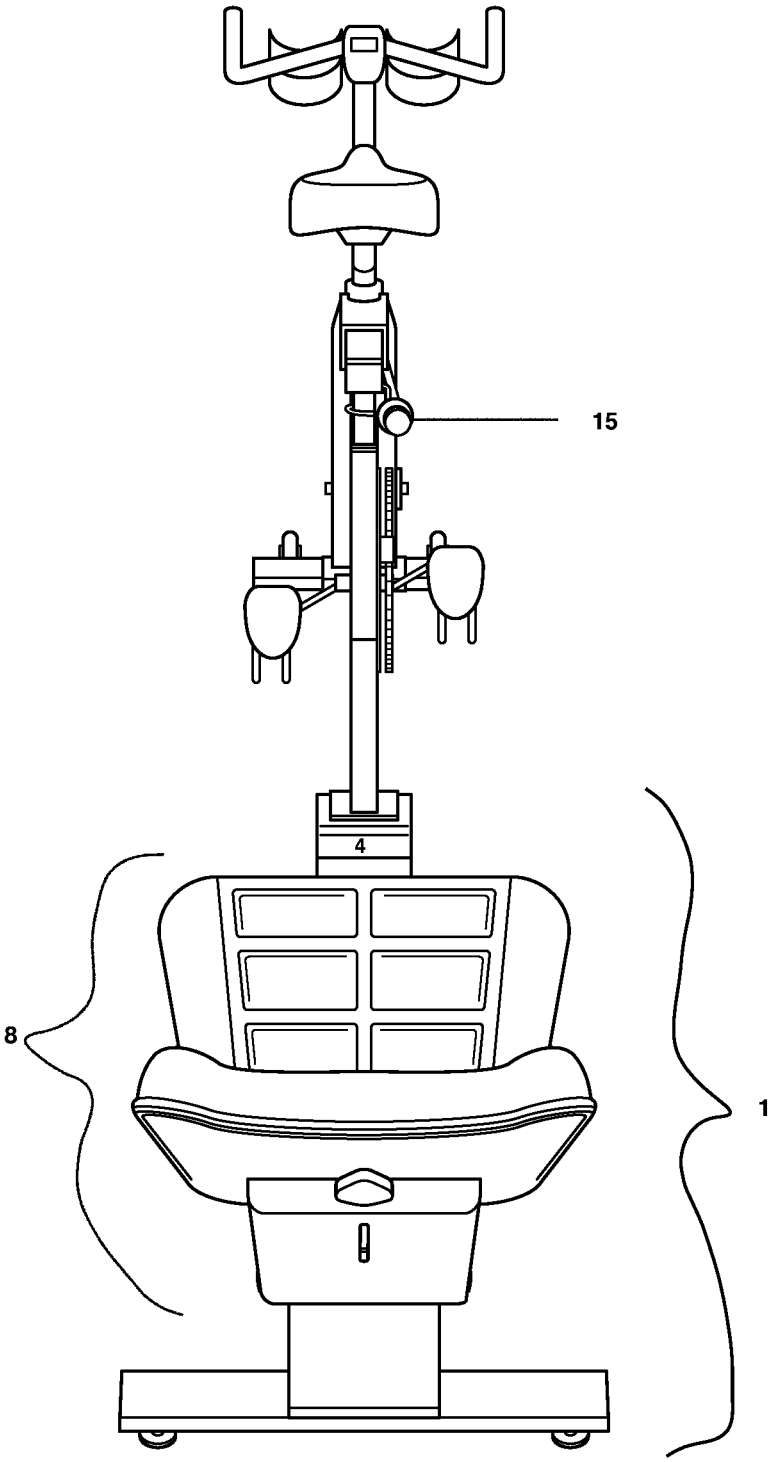
Figure 3:
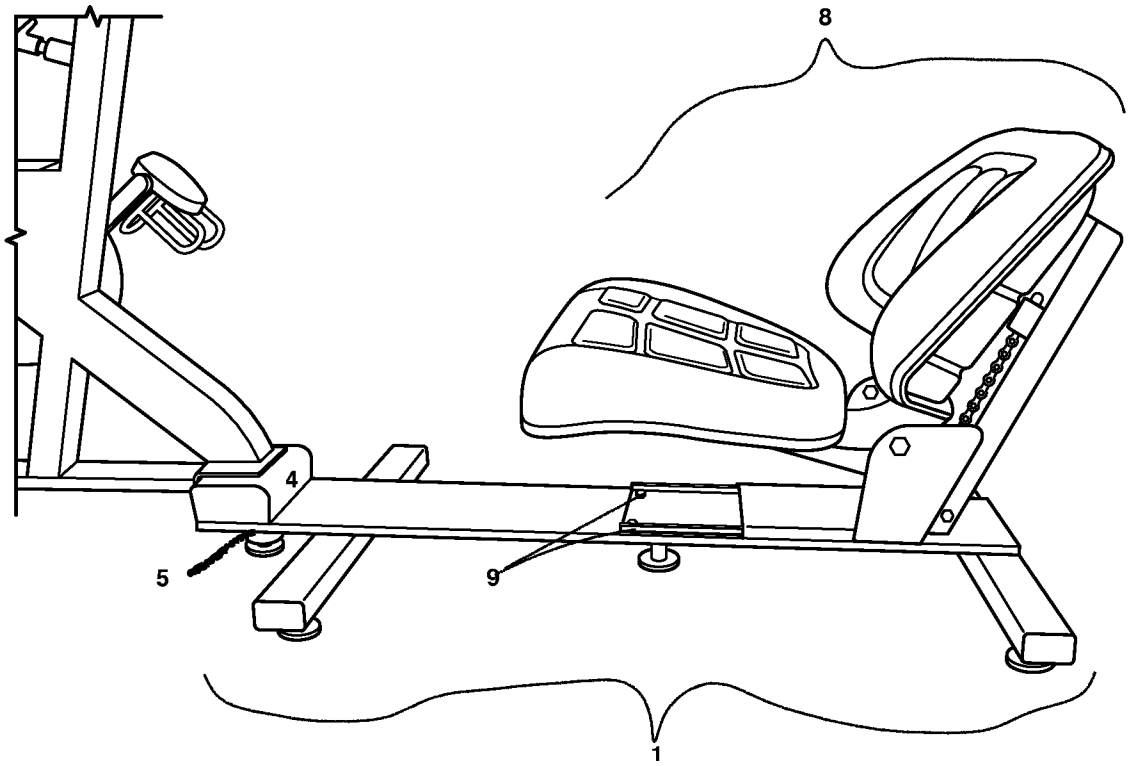
Figure 4:
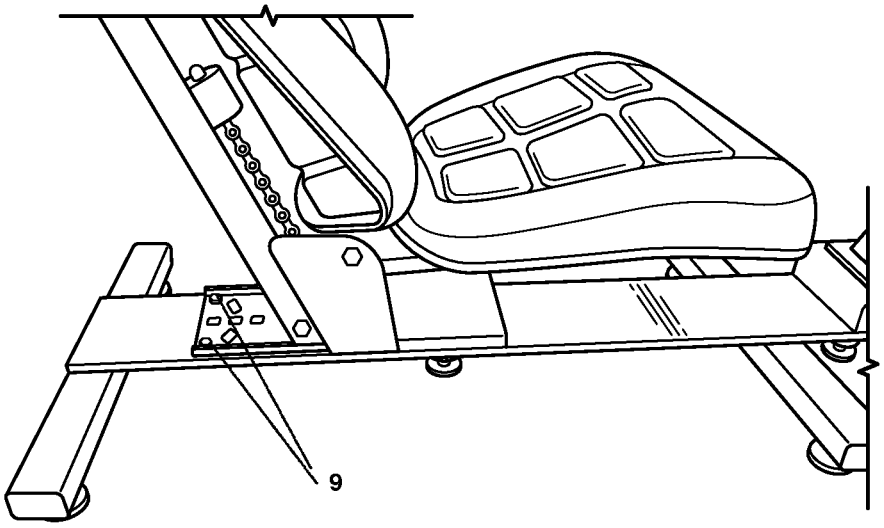
Figure 5:
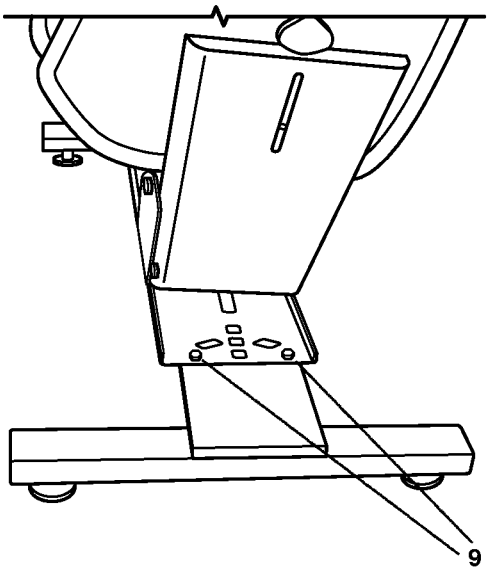
Figure 6:
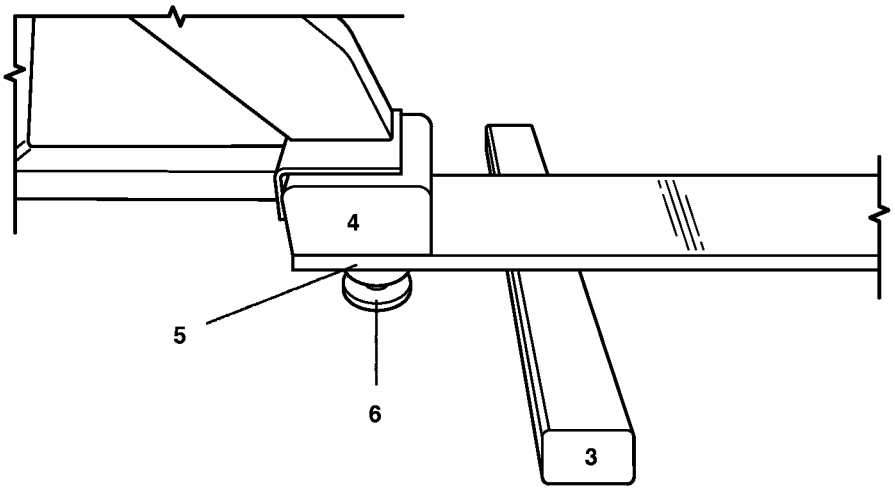
Figure 7:
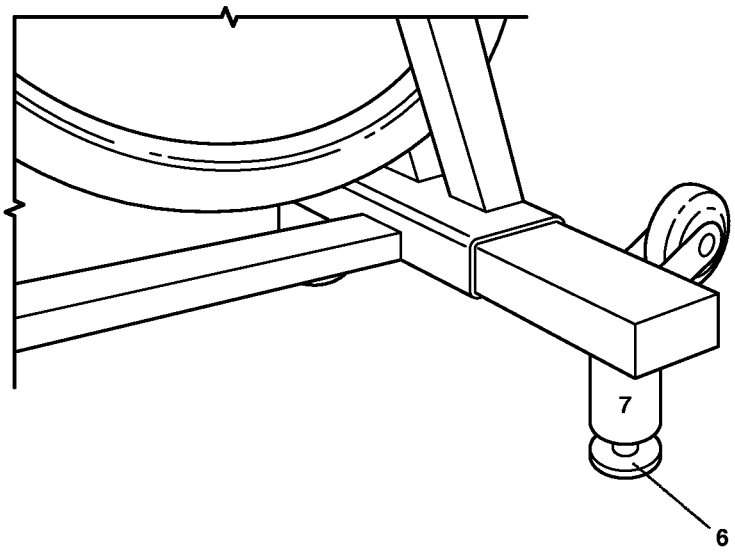
Figure 8:
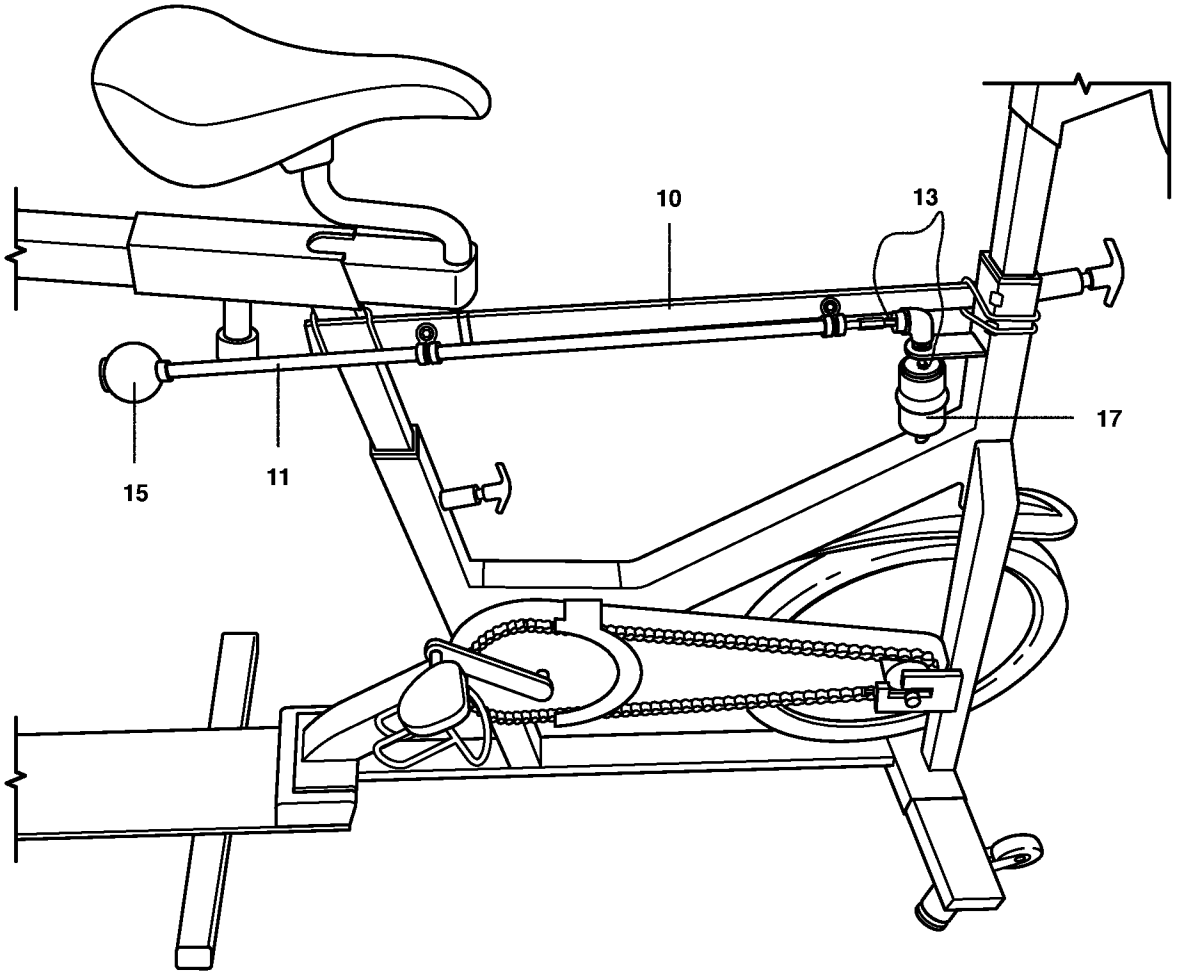
Figure 9:
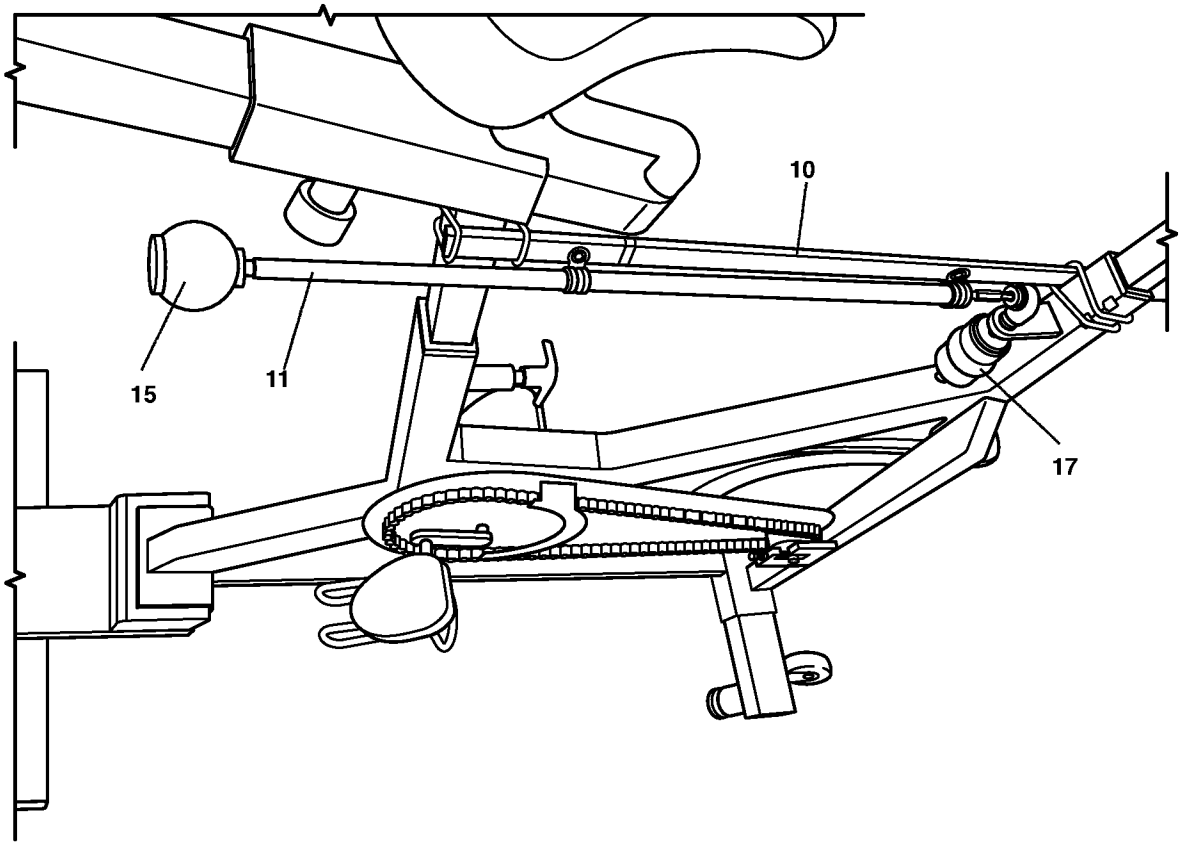
Figure 10:
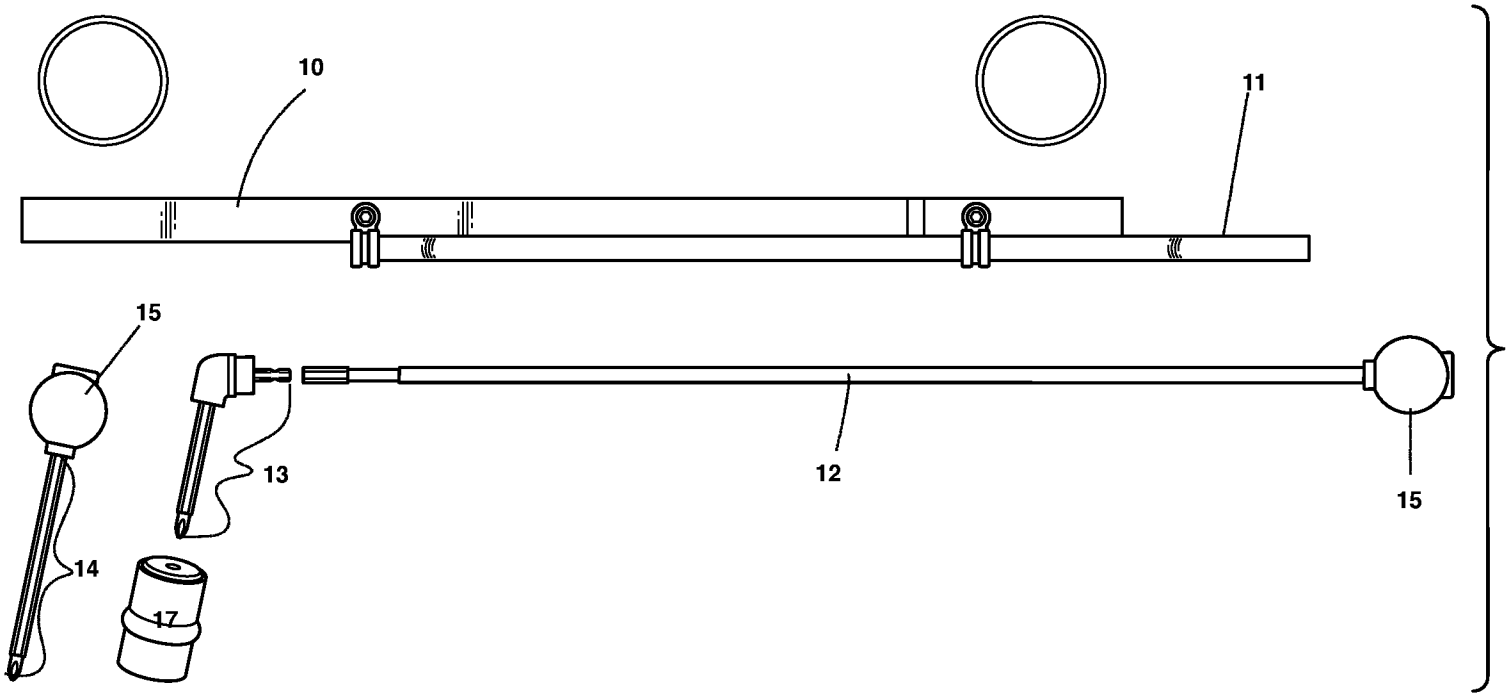
Figure 11:
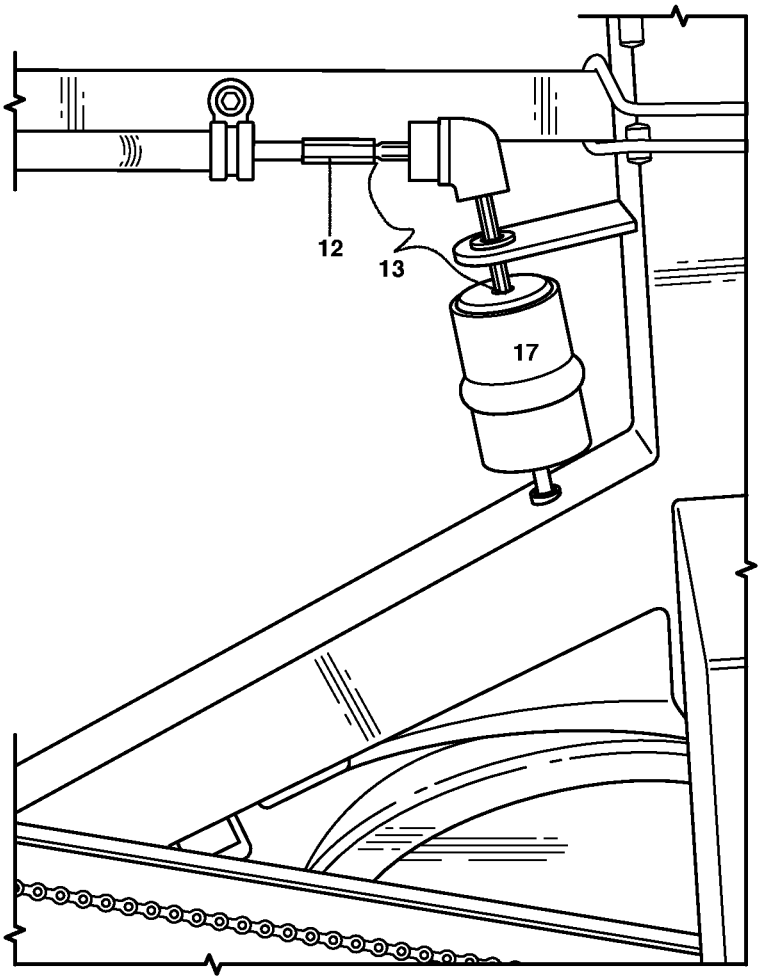
Figure 12:
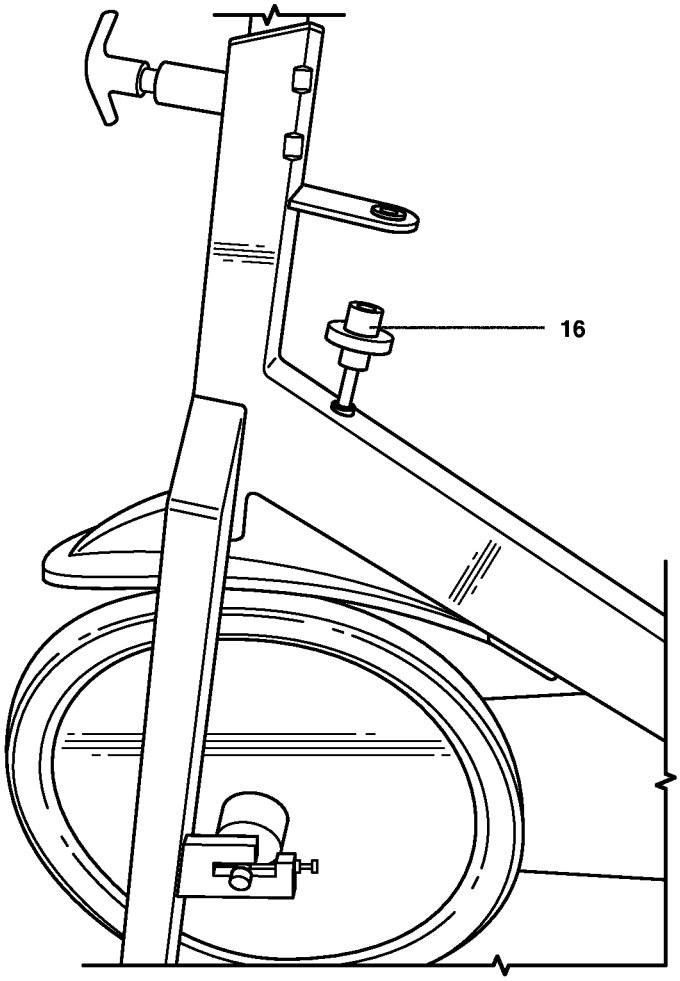

The Recumbent Exercise Bicycle Attachment (REBA) prototype was designed to attach to the Star Trac Spinner Elite, Model Number 9-6900-SINTPO, manufactured in August 2006. The REBA consists of four components that provide for its integration with the Spinner Elite (SE): Platform, Risers, Seat, and Controls.

Platform 1

The platform consists of six pieces, welded together, and further modified to provide for use of standard adjustment feet utilized by the SE for leveling purposes.

Platform Base 2

One, 6" by 40¼" made from half inch-thick steel plate

Plate is drilled to receive seat as follows—measured from the rear face of the Spacer Bar described below—Two front holes 11/32" diameter 18 3/32" centered on platform 2½" on center, Two rear holes 11/32" diameter 30¼" centered on platform 4⅜" on center Cross Supports 3

Two, 20½" long made from 1½"×2" eleven gage square steel tube

Center Support

One, 30" long, made from 1½"×1" eleven gage square steel tube

Centered on and welded to underside of platform between cross supports (not shown on drawings)

Spacer Bar 4

One, 6" long made from 2"×4" eleven gage square steel tube

Support Foot 5

One, 1½" long made from 2" diameter solid steel bar, drilled and tapped for ½" (thirteen thread), to accept standard SE leveling foot The cross and center supports are drilled to accept ½" nuts (thirteen thread) that are welded in place to accept standard SE leveling feet (6). These receivers are similar to those used for this purpose on the SE. The platform is welded together, and then drilled through at the spacer bar, to allow for attachment to the SE. The device is attached at the SE rear support bracket by removing existing rear support cross piece, and through-bolted in place, using two hex drive flat head machine screws, 8-millimeter, 1.25 pitch, 3¼" long with locking nuts.

Removal of the existing SE rear cross support is necessary both for attachment of the device platform and pedal clearance.

In conjunction with the seat and risers described below, the platform does the following:

Provides a solid base for seat mounting

Lifts the entire SE 3¾" to allow pedal clearance of floor. Additional clearance can be obtained by extending leveling feet.

Creates a seat position that is approximately 4⅜" lower than the axis of the pedal sprocket.

This offset is consistent for the most part with existing recumbent bicycle geometry and lacking in most stand-alone recumbent exercise bicycles. This offset can be reduced by raising the seat using spacers. This seat position provides the user with a solid, comfortable, supportive, slightly laid-back riding position that removes pressure from the user's feet, except that which comes from flywheel resistance.

Risers 7

Two made from 3/32"×2" diameter by 2½" long steel tube

The top of each has a 1¼" long by ½" (thirteen thread) stud centered and welded in place, recessed as necessary for tight fit to existing SE front cross support. The bottom of each riser is closed with a steel cap welded in place. Caps are center-drilled to receive ½" (thirteen thread) nuts welded in place to receive standard leveling feet (similar to platform cross supports).

Risers attach to existing SE front cross support by screwing studs described above into receivers vacated by removing the existing leveling feet. Risers provide a solid stable footing for the front of the bicycle, as well as necessary height.

Seat 8

A and I Products Tractor Suspension Seat A-T222BL

Seat attaches to Platform Base where drilled as described above using four 1" long 5/16" diameter stainless steel (eighteen thread) bolts with locking nuts (9). The seat contains integral track adjustment that allows the attachment to accommodate users of different heights. The seat has comfortable vinyl back and bottom cushions. These cushions are well-made with molded steel frames that attach to the seat frame with bolts. They are easily cleaned and can be replaced.

Controls

Components and Assembly

Control Bar 10

27"×1"×1/4" aluminum, drilled for attachment of Rear Control Rod Guide Tube described below Front hole, 1/4" diameter—8 1/4" from front end Rear hole, 1/4" diameter—3 3/4" from rear end Two large O rings, ID—2 7/8" wall thickness—3/16" used for attaching Control Bar to SE Three small O rings, ID—9/16" wall thickness—1/8" used for buffering Rear Control Rod Guide Tube 11

23"×1/2" diameter stainless steel tube

Two 1/2" rubber insulated stainless steel clamps

Two stainless steel bolts, 1/4"×1" (twenty thread)

Two stainless steel locking nuts, 1/4" (twenty thread)

Spacers (two per bolt) 1/4" stainless steel washers

The Control Assembly is bolted together using the Components described above, as follows:

Rear Guide Tube bolts to right side of Control Bar, using clamps, bolts, nuts, and spacer washers. Front clamp determines position of Guide Tube on Control Bar, by positioning front of tube flush with front of clamp. Clamps orient down, bolts inserted through clamps, with spacer washers (two per bolt) between clamp and bar, nuts on left side of bar. Prior to assembly, slide small O rings described above onto Control Bar, approximately five inches from back of bar.

After assembly, adjust to provide buffering between top edge of Control Bar, and bottom of horizontal seat tube.

The assembled Control Bar attaches to SE as follows:

Front of Control Bar attaches to left side of handle bar down tube, approximately 1 1/2" from top of tube, using O Rings described above. O Ring loops tube on right side, allowing Control Bar to be pulled tight to said tube.

Back of Control Bar attaches directly to right side of seat post, with top of Control Bar approximately 1/8" below bottom of horizontal seat tube, (used for lateral seat adjustment). O ring is looped on left side of seat post, allowing Control Bar to be pulled tight.

The SE seat must be set with three and one-half adjustment holes exposed on front of seat post. This seat height position provides correct placement of rear control rod knob, allowing user adjustment from recumbent riding position. Flexible O Ring attachment permits seat to be raised and lowered for conventional riding Rear Control Rod 12

3/8" diameter stainless steel rod 26 1/8" long

Length includes 1/4 hex nut driver, 2 1/4" long, welded to rod front end

Rod threaded 5/8" in from back (sixteen thread), to receive socketed knob, described below Total length assembled 27 1/2" including driver and knob Angle Drive 13

Used in conjunction with Rear Control Rod described above to convert horizontal rotational motion to vertical rotational motion necessary to turn new control knob assembly described below Jelbow, 105 degrees, with 1/4" hex drive shaft and 1/4" magnetic chuck to receive 1/4" hex drive, with phillips head, 3 1/2" long Front Control Rod 14

3/8" diameter stainless steel rod, 5 7/8" long

Length includes 1/4" hex drive, with phillips head, 2" long, welded to rod front end Rod threaded 5/8" in from back, 3/8" (sixteen thread), to receive socketed knob described below Total length assembled 7 7/8" including driver and knob Plastic Control Knobs 15

Fixture Works 06245-04A46, two pieces

Diameter 1.97 inches, Height 2.01 inches

Metal insert threaded to receive 3/8" threaded rod (sixteen thread)

New Flywheel Brake Control Rod 16

7 3/4" long, 10-millimeter all-thread, 1.50 thread pitch

Washer Assembly—six 1 5/8" fender washers, drilled out to 13/32", unitized by face-gluing with Gorilla Glue Four 10-millimeter nuts, 1.50 thread pitch Washer Assembly is installed at the top of the New Brake Control Rod by double nutting at top and bottom faces with nuts described above using blue Loctite Exact placement determined by flushing out the top nut with top of Rod Rod is installed by screwing bottom of Rod into the existing flywheel brake assembly (just above flywheel)

This installation places Washer Assembly below the existing brake control knob shaft bracket on the SE, (ready to receive New Control Knob Assembly described below)

New Control Knob 17

Coupler hose—1 1/2" diameter by 3" long

Steel Knob Unit—1 1/2" diameter by 1 3/4" long 3/32" steel tube with flat steel cap welded on top.

Cap is center-drilled to provide for welding 1/2" long, 1/4" hex drive sleeve inside knob. Sleeve is made by modifying 1/4" hex impact socket to receive 1/4" hex drives described in Angle Drive and Front Control Rod above.

The Steel Knob Unit press fits into the top of the coupler hose described above (slightly proud)

The assembled Unit then press fits onto the New Brake Control Rod Washer Assembly described above.

Finish

All metal pieces of the device except fasteners, various hex drives, and stainless-steel control components are powder-coated Riding Conventionally Insert new Front Control Knob shaft through existing SE brake control knob shaft bracket, into new Metal Knob Assembly. Phillips point at end of shaft rests on top end of New Flywheel Brake Control Rod. 1/4" hex drive engages with the hexagonal sleeve of the new Metal Knob Assembly described above, providing for flywheel resistance adjustment by turning the new Flywheel Brake Control Rod. Turn new Front Control Rod Knob clockwise to increase flywheel resistance, and counter-clockwise to decrease flywheel resistance, (same as old SE Control Knob).

Riding Recumbently

Remove new Front Control rod. Connect Jelbow to SE as follows: Insert 1/4" hex drive with phillips head 3 1/2" long into magnetic chuck.

Hex drive engages with SE as described above, (Riding Conventionally)

Slide Rear Control Rod through Rear Control Rod Guide Tube until nut driver exits front of tube.

Engage with Jelbow by pushing nut driver onto Jelbow hex drive shaft. Exert necessary pressure by pushing on plastic knob at back end of Rear Control Rod. Adjust flywheel resistance as described above, (Riding Conventionally).

Alternative Embodiments

The device could be constructed from various materials other than those described above, using other methods of construction.

For example:

1. Platform components could be made from aluminum or other material, and through-bolted rather than welded.
2. Risers could be machined from solid stock, drilled and tapped to receive attachment studs and adjustment feet. Alternatively, a single pedestal could be made and configured to attach to the existing front cross support, or directly to the existing front cross support bracket.
3. A seat other than described could be constructed; seat cushions could be part of a custom seat utilizing a frame in conjunction with an automotive seat track.
4. The controls described above could vary with respect to materials, method of function including configuration and means of attachment.
5. The Control Bar could be made of plastic or other material.
6. Various brackets could be used for Control Bar attachment rather than O rings.
7. The existing upright bicycle could be slightly modified to allow for Control Bar attachment using various types of studs.
8. The New Control Knob Assembly and face-glued washers can be eliminated entirely as follows: The New Flywheel Brake Control Rod could be adjusted in length and fitted with a 10-millimeter bolt connector jam nutted in place at the connector's bottom end.
9. A quarter inch hex drive bit extender could be modified as follows: ten-millimeter threads could be cut on the extender to within approximately ¼" of the extender's end. The extender could be cut to approximately ¾" in length, as measured from the unthreaded end of the extender. The modified extender could be screwed into the top end of the bolt connector using red Loctite. The modified extender could accept both the phillips drive chucked into the Jelbow used in conjunction with the Rear Control Rod and the Front Control Rod.
10. Various attachments could be incorporated to provide additional features for example; a table top with a post similar to that of the upright exercise seat, when removed, could be used to hold electronic devices.
11. The device could be incorporated as an integral part of a new upright exercise bicycle or constructed as a stand-alone unit utilizing existing pedaled flywheel technology.

The invention claimed is:

1. A recumbent exercise bicycle attachment apparatus for use with a stand-alone upright exercise bicycle, wherein the upright exercise bicycle comprises a saddle, a flywheel, pedals for turning the flywheel, and a control for varying the resistance against the flywheel, the recumbent exercise bicycle attachment apparatus comprising:

a seat;

a new control knob;

a new flywheel brake control rod configured to be attached to the new control knob;

a rear control rod configured to receive horizontal motion; and an angle drive configured to convert horizontal motion from the rear control rod to vertical motion to the new flywheel brake control rod;

wherein, when the recumbent exercise bicycle attachment apparatus is attached to the upright exercise bicycle, a user is capable of adjusting the resistance against the flywheel by turning the rear control rod.

* * * * *